United States Patent [19]

Daubendiek

[11] Patent Number: 4,672,026

[45] Date of Patent: Jun. 9, 1987

[54] PHOTOGRAPHIC ELEMENTS CONTAINING BRIGHT YELLOW SILVER IODIDE

[75] Inventor: Richard L. Daubendiek, Rochester, N.Y.

[73] Assignee: Eastman Kodak Company, Rochester, N.Y.

[21] Appl. No.: 784,139

[22] Filed: Oct. 4, 1985

[51] Int. Cl.[4] ..... G03C 1/00

[52] U.S. Cl. ..... 430/495; 430/567; 430/569

[58] Field of Search ..... 430/569, 567, 495

[56] References Cited

U.S. PATENT DOCUMENTS

| | | | |
|---|---|---|---|
| 2,327,764 | 8/1943 | Carroll | 430/512 |
| 4,094,684 | 6/1978 | Maskasky | 430/569 |
| 4,142,900 | 3/1979 | Maskasky | 430/569 |
| 4,158,565 | 6/1979 | Maskasky | 430/569 |
| 4,349,622 | 9/1982 | Koitabashi et al. | 430/569 |
| 4,451,561 | 5/1984 | Hirabayashi et al. | 430/614 |
| 4,459,353 | 7/1984 | Maskasky | 430/569 |
| 4,490,458 | 12/1984 | House | 430/569 |

FOREIGN PATENT DOCUMENTS

| | | |
|---|---|---|
| 505012 | 8/1930 | Fed. Rep. of Germany . |
| 2053499A | 6/1979 | United Kingdom . |
| 823271 | 4/1981 | U.S.S.R. . |

OTHER PUBLICATIONS

Walliser et al, "Geland Solution Growth of Large Crystals of Silver Iodide," Journal of Photo Sci, vol. 27, 1979, pp. 85–96.

Costa et al, "Basic Luminescence Parameters for Silver Halide Crystals and Photographic Emulsions, 1.77K Luminescence," Photo. Science and Eng. vol. 23, No. 5, Sep./Oct. 1979, pp. 283–286.

Saijo et al, "Electron Microscopic Study of the Growth of Sub-Microcrystals in Nascent Silver Iodide and Silver Bromoiodide Hydrosols", Photo. Science and Eng., vol. 26, No. 2, Mar./Apr. 1982, pp. 92–97.

Byerley & Hirsch, "Dispersions of Metastable High Temperature Cubic Silver Iodide", *Journal of Photographic Science,* vol. 18, 1970, pp. 53–59.

Steigmann, Photographische Industrie, "Green and Brown Developing Emulsions", vol. 34, pp. 764, 766, and 872, published Jul. 8 and Aug. 5, 1938.

Sharkov, Dobroserdova & Panfilova, "Crystallization of Silver Halides in Photographic Emulsions IV. Study by Electron Microscopy of Silver Iodide Emulsions", *Zh. Nauch. Prikl, Fot. Kine,* Mar.–Apr., 1957, 2, pp. 102–105.

James, *The Theory of the Photographic Process,* 4h Ed., Macmillan, 1977, pp. 1 and 2.

Maskasky, *Research Disclosure,* Item 16158, vol. 161, pp. 84–87, Sep. 1977.

Maskasky, *Research Disclosure,* Item 18153, vol. 181.

Daubendiek, "AgI Precipitations: Effects of pAg on Crystal Growth(PB)", II-23, Papers from the 1978 International Congress of Photographic Science, Rochester, N.Y., pp. 140–143, 1978.

*Primary Examiner*—Jack P. Brammer

*Attorney, Agent, or Firm*—Carl O. Thomas

[57] ABSTRACT

An element is disclosed containing an emulsion comprised of silver iodide grains which are stable at room temperature and are bright yellow. In a preferred form the element is a photographic element.

7 Claims, No Drawings

PHOTOGRAPHIC ELEMENTS CONTAINING BRIGHT YELLOW SILVER IODIDE

FIELD OF THE INVENTION

This invention relates to elements containing silver iodide grains. In one specific form the invention relates to photographic elements.

BACKGROUND OF THE INVENTION

Emulsions comprised of a dispersing medium and silver halide microcrystals or grains have found extensive use in photography. Radiation sensitive silver halide emulsions have been employed for latent image formation. The radiation sensitive silver halide grains employed in photographic emulsions are typically comprised of silver chloride, silver bromide, or silver in combination with both chloride and bromide ions, each often incorporating minor amounts of iodide. Radiation sensitive silver iodide emulsions, though infrequently employed in photography, are known in the art. Silver halide emulsions are known to be useful in photographic elements for purposes other than latent image formation, such as for radiation absorption or scattering, interimage effects, and development effects.

In general silver halides exhibit limited absorption within the visible spectrum. Progressively greater blue light absorptions are observed in silver chloride, silver bromide, and silver iodide. However, even silver iodide emulsions appear pale yellow, with their principal light absorption occurring near 400 nm.

The crystal structure of silver iodide has been studied by crystallographers, particularly by those interested in photography. The most commonly encountered crystalline class of silver iodide is the hexagonal wurtzite class, hereinafter designated $\beta$ phase silver iodide. Silver iodide of the face centered cubic crystalline class, hereinafter designated $\gamma$ phase silver iodide, is also stable at room temperature. The $\beta$ phase of silver iodide is the more stable of the two phases so that emulsions containing $\gamma$ phase silver iodide grains also contain at least a minor proportion of $\beta$ phase silver iodide grains.

Byerley and Hirsch, "Dispersions of Metastable High Temperature Cubic Silver Iodide", *Journal of Photographic Science,* Vol. 18, 1970, pp. 53–59, have reported emulsions containing a third crystalline class of silver iodide, the body centered cubic class, hereinafter designated $\alpha$ phase silver iodide. $\alpha$ phase silver iodide is bright yellow, indicating that it exhibits increased absorption in the blue portion of the spectrum as compared to $\beta$ and $\gamma$ phase silver iodide, which are cream colored. The emulsions containing $\alpha$ phase silver iodide studied by Byerley and Hirsch were unstable in that they entirely reverted to cream colored silver iodide at temperatures below 27° C.

The teachings of Byerley and Hirsch are considered to represent the prior art most relevant to this invention. Additional art relating to silver iodide is identified and discussed in the Related Art Appendix following the Examples.

SUMMARY OF THE INVENTION

In one aspect this invention is directed to an element comprised of a support and, coated on said support, an emulsion comprised of a dispersing medium and silver iodide grains, the silver iodide forming the grains exhibiting at temperatures below 25° C. an absorption transition wavelength that is bathochromically displaced by at least 10 nm as compared to the absorption transition wavelength of $\beta$ phase silver iodide.

The silver iodide emulsion identified above is more efficient than either $\beta$ or $\gamma$ phase silver iodide emulsions in absorbing blue light. The silver iodide emulsion can be employed solely to perform a blue light absorption function, as when employed to filter blue light, or the silver iodide emulsion can be employed for latent image formation, i.e., as a radiation sensitive emulsion. In either instance, the greater absorption of blue light is an advantage of these elements over otherwise comparable elements employing $\beta$ or $\gamma$ phase silver iodide.

DESCRIPTION OF PREFERRED EMBODIMENTS

This invention relates to elements containing at least one silver iodide emulsion that is highly efficient in absorbing blue light at ambient temperatures—e.g., at temperatures of less than 25° C. By a unique preparation procedure set forth below in the Examples it has been possible for the first time to prepare a silver iodide emulsion that is bright yellow at ambient temperatures.

The bright yellow color of the silver iodide emulsion is an important quality, since it is visible proof that a higher proportion of blue light is being absorbed at ambient temperatures than is absorbed at these temperatures by conventional silver iodide emulsions. Silver iodide emulsions heretofore observed at ambient temperatures have appeared pale yellow.

The blue light absorption advantage of the bright yellow silver iodide emulsions can be quantitatively expressed by observing that the absorption transition wavelength in the blue spectrum is bathochromically displaced more than 20 nm as compared to the blue spectrum absorption transition wavelength of a corresponding silver iodide emulsion in which the silver iodide consists essentially of $\beta$ phase silver iodide. The "blue spectrum" is the portion of the visible electromagnetic spectrum extending from 400 to 500 nm. The "transition wavelength" is defined as the longest blue spectrum absorption wavelength that separates a hypsochromic 20 nm spectral interval and a 20 nm bathochromic spectral interval differing in that absorption variance is at least 5 times greater in the hypsochromic spectral interval than in the bathochromic spectral interval.

Silver iodide emulsions all show a relatively high absorption at 400 nm and a relatively low absorption at 500 nm. A steep transition in absorption occurs within the blue spectrum. For silver iodide of differing crystal classes the rise from low to high absorptions occurs at differing blue wavelengths. The transition wavelength identifies the onset or toe of the absorption rise in traversing the blue spectrum from longer to shorter wavelengths. As an illustration, in the examples below the silver iodide emulsion satisfying the requirements of this invention exhibits an absorption variance of about 1% between 520 and 490 nm and an absorption variance of about 20% between 490 and 470 nm. For this emulsion coating the transition wavelength is 490 nm. The transition wavelength for a corresponding emulsion consisting essentially of $\beta$ phase silver iodide grains is 455 nm, since the bathochromic 20 nm interval exhibits an absorption variance of about 1% while the hypsochromic 20 nm interval exhibits an absorption variance of 14%. In this comparison there is a 35 nm difference in the transition wavelengths of the two silver iodide emulsion coatings.

The transition wavelength of the emulsions employed in the practice of this invention is referenced to the transition wavelength of emulsions consisting essentially of $\beta$ phase silver iodide grains, since this is the most readily prepared and most stable form of silver iodide. Emulsions which contain $\gamma$ phase silver iodide also contain $\beta$ phase silver iodide in varying proportions. It is recognized that the presence of $\gamma$ phase silver iodide shifts the transition wavelength bathochromically to some extent as compared to the transition wavelength of emulsions consisting of $\beta$ phase silver iodide. However, the presence of $\gamma$ phase silver iodide can not alone account for a 20 nm bathochromic displacement of the transition wavelength as compared to $\beta$ phase silver iodide.

When the transition wavelength of emulsions employed in the practice of this invention is at least 20 nm greater than the transition wavelength of emulsions consisting essentially of $\beta$ phase silver iodide grains, the transition wavelength occurs at a longer wavelength than any heretofore known silver iodide emulsion which is stable at ambient temperatures. In preferred embodiments of the invention the emulsions employed are silver iodide emulsions exhibiting a transition wavelength which is at least 30 nm bathochromically displaced as compared to the transition wavelength of silver iodide consisting essentially of $\beta$ phase silver iodide.

It is to be noted that the transition wavelength of silver iodide emulsions varies as a function of average grain size and silver coating coverage. Thus, in comparing emulsions containing silver iodide grains of differing crystallographic classes corresponding average grain sizes and silver coating coverages are necessary. When emulsions of varied grain sizes and silver coating coverages differing only in the crystallographic class of the silver iodide are compared, the differences in their transition wavelengths are remarkably constant.

The silver iodide emulsions employed in the practice of this invention contain silver iodide grains—that is, grains which have an identifiable discrete silver iodide phase. Attempts to identify the crystallographic class of the silver iodide have been unsuccessful, except to the extent that it has been determined that neither $\alpha$ phase, $\beta$ phase, $\gamma$ phase silver iodide, nor mixtures of these silver iodide phases can account for all the observed properties of the silver iodide emulsions prepared and employed. That is, at least a significant portion of the silver iodide exhibits properties differing from the three known phases of silver iodide. It is, of course, recognized that silver iodide emulsions prepared as described below can be blended with conventional silver iodide emulsions and still satisfy the requirements of this invention, provided transition wavelength requirements of this invention are preserved.

The bright yellow silver iodide grain population of the emulsions are prepared using the general double jet precipitation techniques known to the photographic art, as illustrated by *Research Disclosure,* Vol. 176, December 1978, Item 17643, Paragraph I, modified as illustrated by the Examples. *Research Disclosure* is published by Kenneth Mason Publications, Ltd., Emsworth, Hampshire P010 7DD, England.

The bright yellow silver iodide grains can be of any convenient size for the application undertaken. Since any ripening out of silver iodide grains which occurs after their initial formation has the effect of increasing the proportion of $\beta$ or $\gamma$ phase sllver iodide, it is preferred to prepare silver iodide grain populations under conditions that are not highly favorable to post precipitation ripening. For example, it is generally most convenient for the silver iodide grains to have an average diameter of greater than 0.05 $\mu$m. Also, it is preferred to prepare the emulsions with a minimum of grain heterodispersity. Monodispered silver iodide grain populations are preferred. In quantitative terms, it is preferred that the bright yellow silver iodide grains exhibit a coefficient of variation of less than about 40 and optimally less than 20.

It is specifically contemplated to blend the bright yellow silver iodide emulsions prepared with each other or with other materials to adjust layer properties. Where silver halide emulsions of widely differing grain sizes are blended, blending is undertaken immediately prior to coating to minimize unwanted ripening of one grain population onto another.

In one simple form an element according to this invention can consist of a silver iodide emulsion satisfying the ambient temperature transition wavelength requirement coated on a support. In a simple application, in which the silver iodide emulsion is employed to absorb blue light of shorter wavelengths than the transition wavelength while reflecting at least one other component of incident radiation, it is apparent that the sole function of the support is to lend structural integrity to the element. Thus, the support can be chosen from a wide variety of materials, such as paper, wood, plastic, glass, metal, semiconductor, and ceramic supports. If the silver iodide emulsion coating is thick enough itself adequately to reflect incident radiation, it is immaterial whether the support is transparent, reflective, or absorptive.

When the element is intended to reflect one component of incident radiation, it is generally preferred that the support be chosen also to reflect that component of incident radiation. This permits the emulsion layer thickness to be adjusted with sole reference to the amount of blue light to be absorbed. To provide a simple illustration of an element contemplated, an element can be constructed consisting of a bright yellow silver iodide emulsion layer coated on a white support. White light directed toward the emulsion layer is reflected as yellow light. If additional absorbers are added, either to the emulsion or in one or more separate layers, the reflected radiation can be further defined. For example, if a cyan dye or particulate pigment is also added to the emulsion layer, blue and red light is absorbed from incident white light while green light is reflected.

If the support is transparent to at least one component of incident radiation, an element according to the invention can be employed as a filter. In its simplest form the filter can consist of a bright yellow silver iodide emulsion layer coated on a transparent support. The filter so formed more efficiently reduces blue light at longer wavelengths than can be achieved using otherwise comparable conventional silver iodide emulsions as filter materials. Again other absorbers, either in the emulsion layer or in separate layers, can be used to restrict further the transmitted component of incident radiation. The filter can be a simple element as described above, a part of an element containing any desired combination of filter layers, or an integrated part of another element, such as a pair of sun glasses.

In a preferred form the elements of this invention are photographic elements in which the silver iodide is employed for absorbing blue light. The preferred photographic elements are those employing a silver halide, which can be the bright yellow silver iodide or another radiation sensitive silver halide, for latent image formation. The discussion which follows is directed specifically to these preferred photographic elements, but it is appreciated that teachings can be applied to photographic elements which do not rely on silver halide for latent image formation as well as other elements, such as filter elements and reflective elements, within the purview of this invention.

In a simple form a silver halide latent image forming photographic element according to this invention can be formed by a latent image forming bright yellow silver iodide emulsion coated on a conventional photographic support, such as a film or paper support. Conventional photographic supports are illustrated by *Research Disclosure,* Item 17643, Paragraph XVII.

In an alternative form the silver halide photographic elements according to this invention can employ one or more additional latent image forming bright yellow silver iodide layers or employ silver halides other than bright yellow silver halide in the bright yellow emulsion layer or in one or more separate emulsion layers. Latent image formation can be accomplished by any one or all of the silver halides incorporated. The diversity of combinations possible can be better appreciated by reference to certain exemplary photographic applications discussed below.

Introducing other silver salts into the silver iodide emulsions is specifically contemplated. In general other silver salts individually exhibit less absorption in the blue spectrum than silver iodide and have a negligible effect on the transition wavelengths of the silver iodide emulsions.

In a specific preferred form of the invention, particularly suited for, but not limited to, employing the silver iodide emulsions for latent image formation, a differing silver salt can be epitaxially grown on the silver iodide grains. Silver chloride is a specifically preferred epitaxially grown silver salt. However, silver thiocyanate, silver bromide, and silver bromoiodide epitaxy on silver iodide are also disclosed in the art. Converted halide epitaxy on silver iodide is also contemplated, e.g., partial displacement of the chloride ions from silver chloride epitaxy by bromide and, optionally, iodide ions. The epitaxial deposition of silver salts can be undertaken in the manner and to the extent heretofore taught in the art, as illustrated by Maskasky U.S. Pat. Nos. 4,094,684, 4,142,900, and 4,158,565, and Koitabashi U.K. Specification No. 2,063,499A, the disclosures of which are here incorporated by reference.

When the bright yellow silver iodide grains are employed for latent image formation, they are preferably sensitized. Epitaxially deposited silver salts, described above, constitute preferred sensitizers for the silver iodide grains. Conventional chemical sensitization techniques, such as middle chalcogen—e.g., sulfur or selenium, noble metal—e.g., gold, and reduction sensitizations described in *Research Disclosure,* Item 17643, Paragraph II, are also contemplated for the emulsions employed in the photographic elements of this invention.

While bright yellow silver iodide absorbs a higher proportion of blue light than other silver iodides and much more than silver chloride or silver bromide, the blue light absorption near 500 nm is still low as compared to absorptions at wavelengths hypsochromic to the transition wavelength. It is therefore contemplated to employ blue spectral sensitizing dyes in combination with the bright yellow silver iodide so that efficient blue light absorption occurs throughout the blue spectrum. Preferred blue absorbing dyes are zero methine merocyanines and monomethine cyanines, such as those described in Maskasky U.S. Pat. No. 4,459,353, here incorporated by reference. Other useful spectral sensitizing dyes for sensitizing the emulsions employed in the practice of this invention in the blue spectrum and other spectral regions—e.g., the green, red, and infrared spectral regions—are methine dyes, such as cyanine, merocyanine, oxonol, hemioxonol, styryl, merostyryl, and streptocyanine dyes, disclosed in *Research Disclosure,* Item 17643, Paragraph III. When the silver iodide grains are being used solely for light absorption, rather than light absorption and latent image formation, a broader range of dyes can be employed to increase absorption. For Example, desensitizing dyes, such as those disclosed by Item 17643, Paragraph III, are useful for this purpose. Other examples of filter dyes are provided by Item 17643, Paragraph VIII.

In addition to the specific features described above, the photographic elements of this invention can employ conventional features, such as disclosed in *Research Disclosure,* Item 17643, cited above and here incorporated by reference. Optical brighteners can be introduced, as disclosed by Paragraph V. Antifoggants and sensitizers can be incorporated, as disclosed by Paragraph VI. Absorbing and scattering materials can be employed in the emulsions of the invention and in separate layers of the photographic elements, as described in Paragraph VIII. Vehicles and hardeners can be employed, as described in Paragraphs IX and X, respectively. Coating aids, as described in Paragraph XI, and plasticizers and lubricants, as described in Paragraph XII, can be present. Antistatic layers, as described in Paragraph XIII, can be present. Methods of addition of addenda are described in Paragraph XIV. Matting agents can be incorporated, as described in Paragraph XVI. Developing agents and development modifiers can, if desired, be incorporated, as described in Paragraphs XX and XXI. When the photographic elements of the invention are intended to serve radiographic applications, emulsion and other layers of the radiographic element can take any of the forms specifically described in *Research Disclosure,* Vol. 184, August 1979, Item 18431, here incorporated by reference. When the photographic elements of the invention are intended to serve dry development applications, emulsion and other layers can take any of the forms specifically described in *Research Disclosure,* Vol. 170, June 1978, Item 17029, here incorporated by reference. A preferred element for dry processing is that disclosed in Sullivan et al U.S. Pat. No. 3,785,830. The bright yellow silver iodide emulsions, as well as other, conventional silver halide emulsion layers, interlayers, overcoats, and subbing layers, if any, present in the photographic elements can be coated and dried as described in Item 17643, Paragraph XV.

The specific features of the photographic elements can be modified for the intended photographic application to be served. The following are exemplary photographic applications and illustrations of forms the photographic elements can take.

In one form the photographic element can take the form of a negative working photographic film or paper employing a bright yellow silver iodide emulsion as above described for latent image formation. In this instance the bright yellow silver iodide grains can form latent image sites primarily on their surface. For example, latent images can be conveniently formed at sensitizing silver salt epitaxy sites on the silver iodide grain surfaces. Alternatively, latent image sites can be formed primarily internally, as by internally incorporating a dopant in the bright yellow silver iodide grains or by halide converting silver salt epitaxy. A silver halide solvent containing developer will reveal the internal latent image sites, permitting development.

In another form the photographic element can take the form of a direct positive photographic element employing the bright yellow silver iodide grains for latent image formation. In this instance direct positive imaging can result from employing the internal latent image forming bright yellow silver iodide emulsions in combination with surface development in the presence of nucleating agents, illustrated by *Research Disclosure,* Vol. 235, Nov. 1983, Item 23510, or accompanied by uniform light exposure. Direct positive imaging employing silver iodide grains which contain halide converted silver chloride epitaxy as internal latent image forming sites is taught by Maskasky U.S. Pat. No. 4,142,900, the teachings of which are directly applicable to this invention. According to another technique the bright yellow silver iodide emulsion can be initially fogged and caused to form a latent image by photobleach of the fog during exposure. In the latter instance internal electron trapping sites can be usefully introduced and electron trapping dyes (commonly referred to as desensitizing dyes) can be employed. These features specific for direct positive imaging are all well known in the art, as illustrated by Item 17643, Paragraph I, cited above.

The negative working and direct positive photographic elements can be employed to produce either black-and-white or color images. For producing color images dye image providing materials can be employed, such as those illustrated by Item 17643, Paragraph VII. Multicolor image forming photographic elements typically include blue, green, and red recording color forming layer units. The bright yellow silver iodide emulsions can be present as one or more layers in any one or all of these color forming layer units.

The photographic elements according to this invention can employ one or more conventional silver halide emulsions for latent image formation, these photographic elements otherwise taking the same general forms described above, and in addition employ one or more bright yellow silver iodide emulsions to absorb or scatter light. For example, the bright yellow silver iodide emulsion can be used as a filter layer to reduce blue light exposure of one or more latent image forming silver halide emulsion layers. Specifically, the bright yellow silver iodide emulsion can supplement or replace a conventional blue absorbing filter layer. Blue absorbing filter layers are commonly employed in multicolor silver halide photographic elements to protect red and green recording emulsion layers from blue light exposure. In this instance the blue absorbing filter is typically located beneath a blue recording color forming layer unit and above green and red recording color forming layer units. Other useful applications for the bright yellow silver iodide emulsions are as overcoats to reduce blue light exposure, undercoats to reduce reflection of blue light and hence blue halation, and blended with other latent image forming silver halide emulsions to reduce intergrain scatter of blue light. The bright yellow silver iodide grains can selectively reduce scatter of blue light while efficiently scattering green and red light. This can have the effect of increasing the green or red speed of an emulsion while simultaneously reducing unwanted blue light exposure.

The photographic elements of the present invention can be imagewise exposed in any conventional manner. Attention is directed to Item 17643, cited above, Paragraph XVIII. Radiant energy employed for exposure can be either noncoherent (random phase) or coherent (in phase), produced by lasers. Imagewise exposures at ambient or reduced temperatures and/or pressures, including high or low intensity exposures, continuous or intermittent exposures, exposure times ranging from minutes to relatively short durations in the millisecond to microsecond range and solarizing exposures, can be employed within the useful response ranges determined by conventional sensitometric techniques, as illustrated by T. H. James, *The Theory of the Photographic Process,* 4th Ed., Macmillan, 1977, Chapters 4, 6, 17, 18, and 23.

The latent image containing photographic elements can be processed following exposure to form a visible image by associating the silver halide with an aqueous alkaline medium in the presence of a developing agent contained in the medium or the element. Processing formulations and techniques known in the art, such as those described in Item 17643, cited above, Paragraph XIX, can be readily adapted for use with the photographic elements of the present invention. Where the bright yellow silver iodide grains are employed for latent image formation at silver chloride epitaxy sites on the grains, the silver chloride can be selectively developed, such processing being more specifically described by Maskasky U.S. Pat. No. 4,094,684.

The photographic elements of this invention can be processed to produce reversal images. That is, direct positive images can be formed by a first black-and-white development followed by uniform fogging of remaining silver halide and color development. In one specific approach more specifically taught by Maskasky U.S. Pat. No. 4,158,565, a photographic element can be constructed incorporating a uniform distribution of a redox catalyst in addition to at least one layer containing a latent image forming bright yellow silver iodide emulsion. When the silver iodide grains are imagewise developed, iodide ion is released which locally poisons the redox catalyst. Thereafter a redox reaction can be catalyzed by the unpoisoned catalyst remaining. Bissonette U.S. Pat. No. 4,089,685, here incorporated by reference, specifically illustrates a useful redox system in which a peroxide oxidizing agent and a dye-image-generating reducing agent, such as a color developing agent or redox dye-releasor, react imagewise at available, unpoisoned catalyst sites within a photographic element.

The photographic elements of this invention can be applied to electrically activated recording. In an exemplary form the photographic element can consist of a conductive support or a conductive layer coated on an insulative support, such as a conventional photographic film or paper support. A bright yellow silver iodide emulsion layer is coated on the conductive surface provided by the support. To avoid light fogging during imagewise exposure the pAg of the bright yellow silver iodide emulsion layer is preferably raised to a sensitivity reducing level—e.g., to a pAg of 10.0 or higher.

The electrically activated photographic element in one form can be as described by Worth U.S. Pat. No. 3,748,137, differing only in that bright yellow silver iodide is substituted for the silver halide disclosed, or as described in Kaukeinen et al U.S. Pat. No. 4,234,670, differing only in that the silver iodide recording material is bright yellow silver iodide. The electrically activated recording element of Reithel et al U.S. Pat. No. 4,201,591 can be adapted to the practice of this invention by substituting silver iodide for the light insensitive silver salts therein disclosed. Exemplary useful conductive support layers are disclosed by Worth, cited above, and Rasch et al U.S. Pat. No. 3,880,167.

A latent image can be formed in the bright yellow silver iodide emulsion layer by applying a potential across the emulsion layer in selected areas. For example, a conducting stylus which differs in potential from the conductive surface of the support can be used to write on the bright yellow silver iodide emulsion layer. The emulsion layer in this instance forms a series component of an electrical circuit completed by the stylus and conducting surface of the support. By varying the potential difference between the stylus and support conductive surface the developable density produced in the emulsion layer can be varied, if desired. Once a latent image is formed by the bright yellow silver iodide, it can be developed to a visible image following known solution development and thermal development techniques.

The foregoing is a description of relatively simple and preferred embodiments. The elements of the present invention as well as the manner in which they are processed can be varied, depending upon the specific photographic application.

EXAMPLES

The invention is further illustrated by the following examples. In each of the examples the contents of the reaction vessel were stirred vigorously throughout silver and iodide salt introductions; the term "percent" means percent by weight, unless otherwise indicated; and the term "M" stands for a molar concentration, unless otherwise stated. All solutions, unless otherwise stated, are aqueous solutions.

Emulsion 1. $\beta$ Phase Silver Iodide (Control)

A reaction vessel equipped with a stirrer was charged with 3.0 L of water containing 80 g of deionized bone gelatin. At 35° C. the pAg was adjusted to 12.6 with KI and maintained at that value during the precipitation. The pH was recorded as 5.50 at 35° C. At 35° C. a 5.0M solution of $AgNO_3$ was added at a linearly accelerating rate (3.83 X from start to finish) over a period of 42.4 min, consuming 4.0 moles Ag. A 5M solution of KI was added concurrently as required to maintain the pAg at 12.6. The pAg was then adjusted to 10.7 with $AgNO_3$. A solution of 80 g of deionized bone gelatin was added. The emulsion was washed by the ion exchange method of Maley, U.S. Pat. No. 3,782,953, and stored at approximately 4° C.

X-ray powder diffraction analysis showed the composition to be 97.7% $\beta$ phase. The average equivalent circular diameter of the grains was found to be about 0.12 $\mu$m.

Emulsion 2. $\beta$ and $\gamma$ Phase Silver Iodide (Control)

A reaction vessel equipped with a stirrer was charged with 2.5 L of water containing 40 g of bone gelatin at 35° C. The pH was adjusted to 6.00 at 35° C. using NaOH and the pAg to 2.45 with $AgNO_3$. At 35° C. a 5.0M solution of $AgNO_3$ was added at a linearly accelerating rate (2.62 X from start to finish) over a period of 20.3 min, consuming 1.0 mole Ag. A 5.0M solution of KI was concurrently added as required to maintain the pAg at 2.45. The pAg was then adjusted to 10.6 with KI. A solution of 60 g of bone gelatin in 200 cc of water was then added. The emulsion was washed and stored similarly as Emulsion 1.

X-ray powder diffraction analysis showed the composition to be 72% $\beta$ and 28% $\gamma$ phase silver iodide. The greater part of the silver iodide was present as grains of an average equivalent circular diameter of 0.11 $\mu$m. A finer grain population of average equivalent circular diameter of about 0.04 $\mu$m was also present.

Emulsion 3. Bright Yellow Silver Iodide (Example)

A reaction vessel equipped with a stirrer was charged with 2.5 L of water containing 35 g of deionized bone gelatin. At 35° C. the pH was adjusted to 5.0 with $H_2SO_4$, and the pAg to 3.5 with $AgNO_3$. At 35° C. a 1.25M solution of $AgNO_3$ was added at a constant rate over 6 min, consuming 0.0038 mole Ag. The flow of $AgNO_3$ was then accelerated following the profile approximated by the equation flow rate=Initial Rate$+0.023t+0.00134t^2$ (t=time of acceleration in min) over a period of 44 min, consuming 0.089 mole Ag. Flow was continued at a constant rate over a period of 70 min, consuming 0.312 mole Ag. This was followed by acceleration on the same profile as previously over 26 min, consuming 0.176 mole Ag. Finally a constant flow over 45 min consumed 0.424 mole Ag. A total of 1.0 mole Ag was consumed in the precipitation. Concurrently with the $AgNO_3$, a 1.25M solution of NaI was added as required to maintain the pAg at 3.36. A 25% deionized bone gel solution containing 50 g of gelatin was added. The pAg was adjusted to 10.1 with KI and the pH to 4.00 with $H_2SO_4$. A 1 L portion of the emulsion was washed as described for Emulsion 1, 17 g of gelatin (25% solution) added, and the pH adjusted to 4.00. The emulsion was stored at approximately 4° C.

X-ray powder diffraction analysis showed some of characteristics to match those of $\alpha$ phase silver iodide, but significant differences from $\alpha$ phase, $\beta$ phase, and $\gamma$ phase silver iodide prevented positive assignment of any art recognized silver iodide crystalline class. Unlike Emulsions 1 and 2, which were pale yellow, Emulsion 3 was bright yellow at room temperature. The grains exhibited an average equivalent circular diameter of 0.09 $\mu$m.

Absorption Spectra

For measurement of the absorption spectra, coatings of each emulsion were made on an acetate support at 0.86 g/m$^2$ Ag, 9.77 g/m$^2$ gelatin. The coating melts were adjusted to pAg 5.0 at 35° C. using $AgNO_3$ or NaI as required, and to pH 4.00 at 35° C., using $H_2SO_4$ or NaOH as required. A sample of Emulsion 3 was coated on the same day it was precipitated. Another sample was coated one week after precipitation, and still another sample was coated four weeks after precipitation. Between precipitation and coating Emulsion 3 was held at 4° C. Spectra were measured using a DIANO MATCH-SCAN® spectrophotometer. From curves plotting percent absorption versus wavelength, it was determined that the absorption transition wavelength was in each instance 490 nm—that is, invariant as a function of the delays in coating. When the transition wavelength of a coating held for four weeks at room temperature was compared with the transition wavelength of a fresh coating, the transition wavelengths of the two coatings were identical. This showed that the silver iodide was in a stable state.

Absorption spectra were obtained using Emulsions 1 and 2 similarly as described above. In each instance Emulsion 1 showed an invariant transition wavelength of 455 nm, and Emulsion 2 showed an invariant transition wavelength of 465 nm. Although Emulsion 2 exhibited a 10 nm bathochromic displacement of the transition wavelength as compared to Emulsion 1, this absorption difference was not sustained at wavelengths shorter than the transition wavelength. At wavelengths shorter than its transition wavelength Emulsion 2 approached the absorption of Emulsion 1, exhibiting essentially the same absorption at a wavelength of 420 nm.

Spectral Sensitivity

For the coatings made with emulsion held for four weeks at 4° C. before coating spectral sensitivity curves were obtained. A sample of the coating was exposed for 32 sec in a spectral sensitometer to a quartz-halogen light source through a Wratten 80B® color correcting filter, diffraction grating with filters to remove second order transmission, and superimposed step wedge. The coatings were developed for 15 min at 20° C. in KODAK D-19® developer containing 1 g/L poly(ethyleneoxide) commerically available as CARBOWAX® 1540, fixed, washed and dried. A characteristic (density versus log E) curve was determined for each coating at 380 nm and at each 10 nm interval between 380 nm and 700 nm. The speed at 0.3 density unit above fog was read from each characteristic curve.

The relative speeds of the three emulsions at differing exposure wavelengths are reported below in Table I.

TABLE I

| | Relative Speed as a Function of Wavelength | | |
|---|---|---|---|
| λ nm | Emulsion 1 | Emulsion 2 | Emulsion 3 |
| 400 | 430 | <10 | 370 |
| 410 | 420 | <10 | 330 |
| 420 | 410 | <10 | 330 |
| 430 | 310 | 100 | 370 |
| 440 | <10 | <10 | 450 |
| 450 | <10 | <10 | 550 |
| 460 | <10 | <10 | 610 |
| 470 | <10 | <10 | 330 |
| 480 | <10 | <10 | 80 |
| 490* | <10 | <10 | <10 |

*All observed relative speeds at wavelengths longer than 490 nm were less than 10

From Table I it is apparent that the photographic element incorporating Emulsion 3 satisfying the requirements of this invention exhibits significantly greater blue speed than either of the photographic elements containing Emulsion 1 or Emulsion 2. Further, the photographic element exhibits relatively high photographic speeds over a much larger portion of the blue spectrum. This demonstrates the superior sensitivity of the photographic elements of this invention.

The sensitivity was also observed of a photographic element according to the invention similar to that described above, but differing in that the emulsion was coated on the same day as precipitation and the coating was held at room temperature for four weeks prior to exposure. Sensitivity characteristics were essentially the same as those reported above.

Emulsion 4. Bright Yellow Silver Iodide (Example)

A 0.10 μm bright yellow silver iodide emulsion was made by the following method: To 1.5 L of an aqueous deionized bone gelatin (2.3% by weight) solution at pH 6.0 were added by double-jet addition a 1.25 molar sodium iodide solution and a 1.25 molar silver nitrate solution. The halide and silver solutions were added over $2\frac{2}{3}$ hours at controlled pAg 3.45 at 35° C. Flow rates followed the profile of $0.4+0.023t+0.00134t^2$ (t=time of acceleration in minutes) where accelerated flow occurred from 7 to 42 minutes, 85 to 91 minutes, and 133 to 142 minutes during the precipitation. Flow rates were constant from 42 to 85 and from 91 to 133 minutes at 2.85 and 3.6 mL/min., respectively. The initial flow rate was 0.4 mL/min., and the final flow rate was approximately 4.9 mL/min. Approximately 1.0 mole of silver was used to prepare the emulsion. Following precipitation the pAg was adjusted to approximately 11.0 at 35° C., and the emulsion was washed by use of ion exchange resins until the pAg was lowered 0.6 unit. The emulsion was then adjusted to pH 6.0 and pAg 11.0 at 30° C.

Samples of Emulsion 4 were chemically sensitized with gold sulfide at concentration levels ranging from 1 to 150 mg/Ag mole.

Samples of Emulsion 4 were spectrally sensitized with benzoxazole carbocyanine, benzimidazole carbocyanine, and merocyanine dyes.

Emulsion 5. Bright Yellow Silver Iodide (Example)

A 0.20 μm bright yellow silver iodide emulsion was prepared by precipitating 1.0 mole of silver iodide onto 0.18 mole of Emulsion 4. Precipitation conditions were similar to those for the preparation of Emulsion 4, except that the precipitation vessel contained 1.3% gelatin and total run time was $3\frac{1}{3}$ hours.

Electrically Activated Recording

A bright yellow silver iodide emulsion of the type described above satisfying the requirements of this invention was coated on a conductive baryta paper support. For exposure the coated element was positioned between PbO photoconductor. and given a 3 Kv exposure using a Faxitron® exposing unit and was processed in an ascorbic acid, lithium bromide, and sodium methoxide in methanol solution for approximately 7 minutes at 20° C. The bright yellow silver iodide displayed a photographic response related to electrical exposure. Other emulsion coatings differing in silver halide content similarly exposed and processed were light fogged by electrical exposure. The bright yellow silver iodide emulsion was not light fogged, since the pAg was raised to an extent sufficient to desensitize the emulsion to light.

The invention has been described in detail with particular reference to preferred embodiments thereof, but it will be understood that variations and modifications can be effected within the spirit and scope of the invention.

Related Art Appendix

Additional art related to silver iodide is listed in chronological order of publication:

1. Steigmann German Pat. No. 505,012, issued Aug. 12, 1930.

2. Steigmann, Photographische Industrie, "Green and Brown Developing Emulsions", Vol. 34, pp. 764, 766, and 872, published July 8 and Aug. 5, 1938.

Items 1 and 2 disclose the preparation of silver halide emulsions having a green tint by introducing sodium chloride into a silver iodide emulsion.

3. Zharkov, Dobroserdova, and Panfilova, "Crystallization of Silver Halides in Photographic Emulsions IV. Study by Electron Microscopy of Silver Iodide Emulsions", *Zh. Nauch. Prikl. Fot. Kine,* March–April, 1957, 2, pp. 102–105.

4. Ozaki and Hachisu, "Photophoresis and Photoagglomeration of Plate-like Silver Iodide Particles", Science of Light, Vol. 19, No. 2, 1970, pp. 59–71.

Items 3 and 4 report silver iodide precipitations with an excess of iodide ions, producing hexagonal crystal structures of predominantly $\beta$ phase silver iodide.

5. James, *The Theory of the Photographic Process,* 4th Ed., Macmillan, 1977, pp. 1 and 2, contains the following summary of the knowledge of the art:

According to the conclusions of Kokmeijer and Van Hengel, which have been widely accepted, more nearly cubic AgI is precipitated when silver ions are in excess and more nearly hexagonal AgI when iodide ions are in excess. More recent measurements indicate that the presence or absence of gelatin and the rate of addition of the reactants have pronounced effects on the amounts of cubic and hexagonal AgI. Entirely hexagonal material was produced only when gelatin was present and the solutions were added slowly without an excess of either $Ag^+$ or $I^-$. No condition was found where only cubic material was observed.

6. Maskasky, *Research Disclosure,* Item 16158, Vol. 161, pp. 84–87, September 1977, discloses the preparation of monodisperse hexagonal bipyramid silver iodide crystals by a double jet precipitation technique which utilized accelerated reactant introduction rates.

7. Daubendiek, "AgI Precipitations: Effects of pAg on Crystal Growth(PB)", II-23, *Papers from the* 1978 *International Congress of Photographic Science,* Rochester, N.Y., pp. 140–143, 1978, reports the double jet precipitation of silver iodide under a variety of conditions. Spectral absorption and X-ray diffraction measurements reportedly gave no indication of $\alpha$ phase silver iodide in the precipitated emulsions examined.

8. Maskasky U.S. Pat. No. 4,094,684, issued June 13, 1978, discloses silver chloride epitaxially deposited on silver iodide grains.

9. Maskasky U.S. Pat. No. 4,142,900, issued Mar. 6, 1979, discloses conversion of silver chloride epitaxially deposited on silver iodide grains using bromide ions.

10. Maskasky *Research Disclosure,* Vol. 181, May 1979, Item 18153, reports silver iodide phosphate photographic emulsions in which silver is coprecipitated with iodide and phosphate.

11. Maskasky U.S. Pat. No. 4,158,565, issued June 19, 1979, discloses the use of grains containing silver chloride epitaxially deposited on silver iodide grains in a dye image amplification process.

12. Koitabashi U.K. Specification No. 2,063,499A, published Feb. 4, 1981, discloses silver bromide or bromoiodide epitaxially deposited on silver iodide host grains.

13. Maskasky U.S. Pat. No. 4,459,353, issued July 10, 1984, discloses high aspect ratio tabular grain $\gamma$ phase silver iodide emulsions.

14. House U.S. Pat. No. 4,490,458, issued Dec. 25, 1984, discloses tabular grain silver iodide emulsions employed in multicolor photographic elements.

What is claimed is:

1. A photographic element comprised of a support and, coated on said support, a radiation sensitive photographic emulsion comprised of a dispersing medium and silver iodide grains, said emulsion exhibiting at temperatures below 25° C. an absorption transition wavelength that is bathochromically displaced by at least 20 nm as compared to the absorption transition wavelength of a $\beta$ phase silver iodide.

2. An element according to claim 1 in which said support is reflective to exposing radiation.

3. An element according to claim 2 in which said support is white.

4. An element according to claim 1 in which said support is transparent.

5. An element according to claim 1 in which said emulsion is coated on a conductive surface of said support.

6. An element according to claim 1 in which said emulsion exhibits at temperatures below 25° C. and absorption transition wavelength that is bathochromically displaced by at least 30 nm as compared to the absorption transition wavelength of $\beta$ phase silver iodide.

7. An element according to claim 1 in which said emulsion additionally contains a dye.

* * * * *